US006722549B2

(12) United States Patent
Shkolnikov et al.

(10) Patent No.: US 6,722,549 B2
(45) Date of Patent: Apr. 20, 2004

(54) ARM MEMBER FOR FASTENER DRIVING TOOL

(76) Inventors: Yury Shkolnikov, 202 Valerie Ct., Glenview, IL (US) 60025; Walter J. Taylor, 1502 N. Green St., McHenry, IL (US) 60050

( * ) Notice: Subject to any disclaimer, the term of this patent is extended or adjusted under 35 U.S.C. 154(b) by 0 days.

(21) Appl. No.: 10/141,466

(22) Filed: May 8, 2002

(65) Prior Publication Data

US 2003/0209584 A1 Nov. 13, 2003

(51) Int. Cl.[7] ..... B25C 1/00

(52) U.S. Cl. ..... 227/10; 227/9; 173/162.2; 248/322; 248/317; 248/324; 248/680; 248/692

(58) Field of Search ..... 227/9, 10, 11, 227/135, 130, 156; 248/690, 691, 692, 674, 322, 339, 317, 324; 173/162.2

(56) References Cited

U.S. PATENT DOCUMENTS 3,468,508 A * 9/1969 Huver ..... 248/314
4,369,487 A * 1/1983 Carlow ..... 362/258
4,406,064 A * 9/1983 Goss ..... 30/298.4
4,787,145 A 11/1988 Klicker et al.
4,895,336 A * 1/1990 Lieberman ..... 348/690
5,332,156 A * 7/1994 Wheeler ..... 239/288
6,230,367 B1 * 5/2001 Riedl ..... 16/436

* cited by examiner

*Primary Examiner*—John Sipos
*Assistant Examiner*—Gloria Weeks
(74) *Attorney, Agent, or Firm*—Lisa M. Soltis; Mark W. Croll; Donald J. Breh

(57) ABSTRACT

An arm member is provided for protection of a power source and for facilitating storage of a power tool. In a closed position, the arm member is configured for partially encircling a portion of the power source and re-directing an impact directed towards that portion away from the power source. In an open position, the arm member is configured for engaging a projection or structure to enable hanging and/or other storage of the power tool.

20 Claims, 4 Drawing Sheets

ARM MEMBER FOR FASTENER DRIVING TOOL

BACKGROUND OF THE INVENTION

The present invention relates generally to portable, combustion powered fastener driving tools, and more specifically to such a tool having a replaceable fuel cell or cartridge.

Portable combustion powered tools for use in driving fasteners into workpieces are described in commonly assigned patents to Nikolich, U.S. Pat. Nos. Re. 32,452; 4,403,722; 4,483,473; 4,483,474; 4,552,162; 5,197,646; 5,263,439; and 6,016,622 all of which are incorporated herein by reference. Similar combustion powered nail and staple driving tools are available from ITW-Paslode under the IMPULSE® brand.

Fastener driving tools using combustion are designed to be portable and to be temporarily hooked or clipped to a user's belt while not in use. These tools include a gun-shaped metal housing and a magazine portion, which is attached to the housing and/or handle. Generally, the magazine retains a supply of fasteners which are fed to a drive track in the housing adapted to receive a fastener and to guide the fastener as the fastener is driven from the drive track into a workpiece.

The housing also includes a piston in a main chamber of the fastener driving tool which is mounted for reciprocal movement along the chamber. The piston is driven by products of combustion supplied to the main chamber by a power source or fuel cell container removably connected to the housing.

The use of existing fastener driving combustion power tools has certain disadvantages. Some current power tool designs protecting the power source or fuel cell offer only partial protection from external impacts, such as when the power tool is dropped. Other power tool designs that more fully protect the fuel cell are unwieldy. As an example, one known power tool design has a fuel cell partially shielded from impact by having one side of the housing protected by a belt clip while the other extended side is left unprotected. Other known tools have a housing that is extended to enclose a power source that is inserted into the housing through a door. Such tools, however, are also larger and more unwieldy as compared to less shielded power tools.

Another disadvantage of some existing power tools is that they are not easily storable at a work site during extended periods of non-use wherein a user prefers to store the tool. For the purposes of this application "storing" refers to hanging or suspending the tool from a structural element. Although belt clips are known for storing tools during these periods, in some cases storing tools in such fashion results in unstable or extraneous movement of the tool while suspended. To overcome such problems, tools are sometimes stored on the ground, which is also unsatisfactory, since this type of storage exposes the tools to dirt, other hazardous ground materials, and/or unwanted impacts. Moreover, the tools are more susceptible to accidental contact and discharge.

SUMMARY OF THE INVENTION

A power tool constructed to drive a driver blade in response to power from a power delivery source to impact a fastener and drive it into a workpiece is disclosed having an arm member or hook for protection of the power delivery source and for storage of the power tool. The arm member is preferably rotatable between a closed position and an open position, based on user interaction. In the closed position, the arm member partially surrounds or at least partially encircles a fuel cell of the tool to protect the fuel cell from external impacts. In the open position, the arm member is configured for engaging a portion of a projection or structure, such as a rafter, ladder, or the like to hang and store the power tool during periods of non-use.

DETAILED DESCRIPTION OF THE PREFERRED EMBODIMENT

Figure 1:
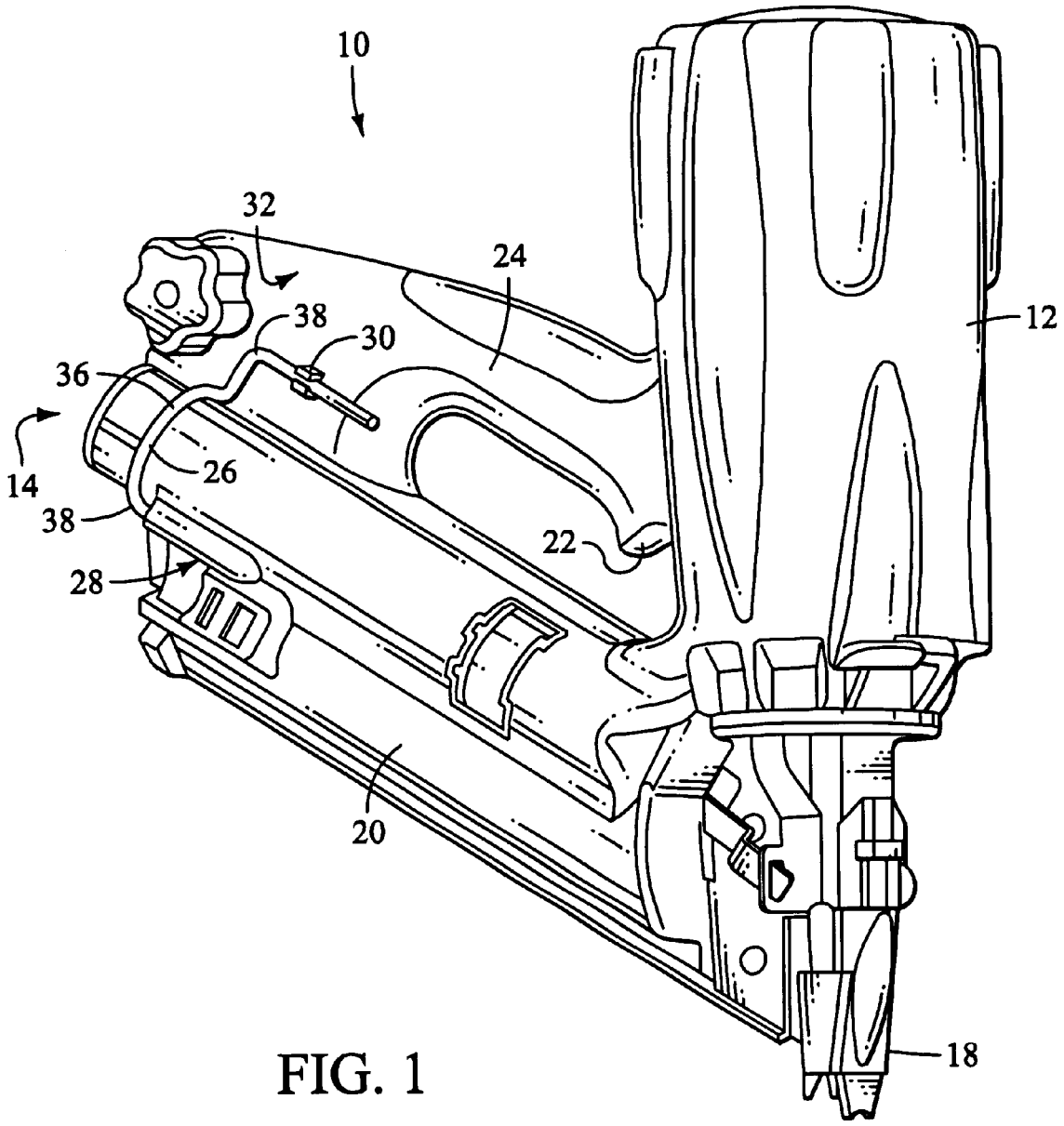
FIG. 1 is a perspective view of a combustion fastener tool in accordance with the present invention.
Figure 2:
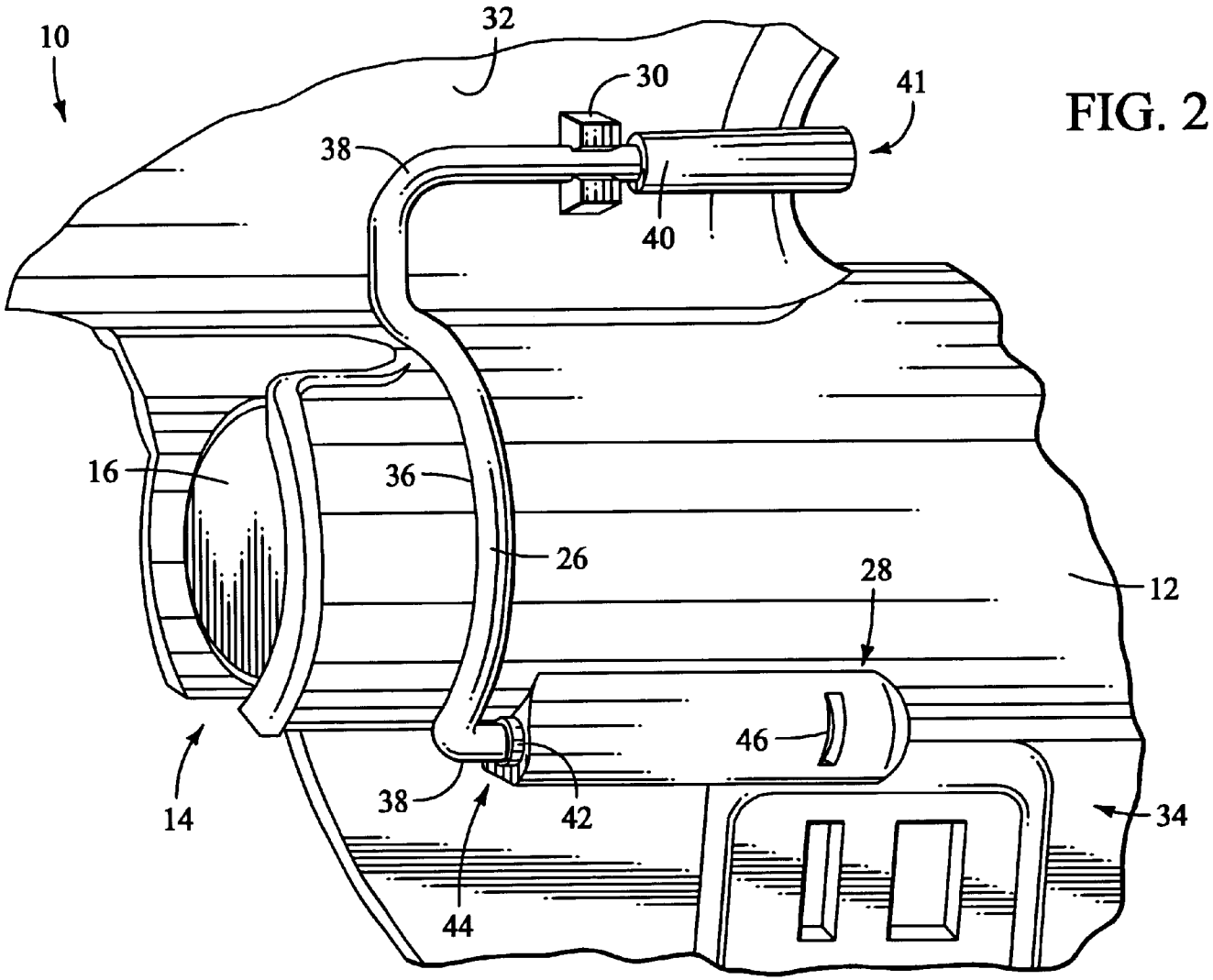
FIG. 2 is a fragmentary rear perspective view of the tool of FIG. 1 showing an arm member in a closed position.
Figure 3:
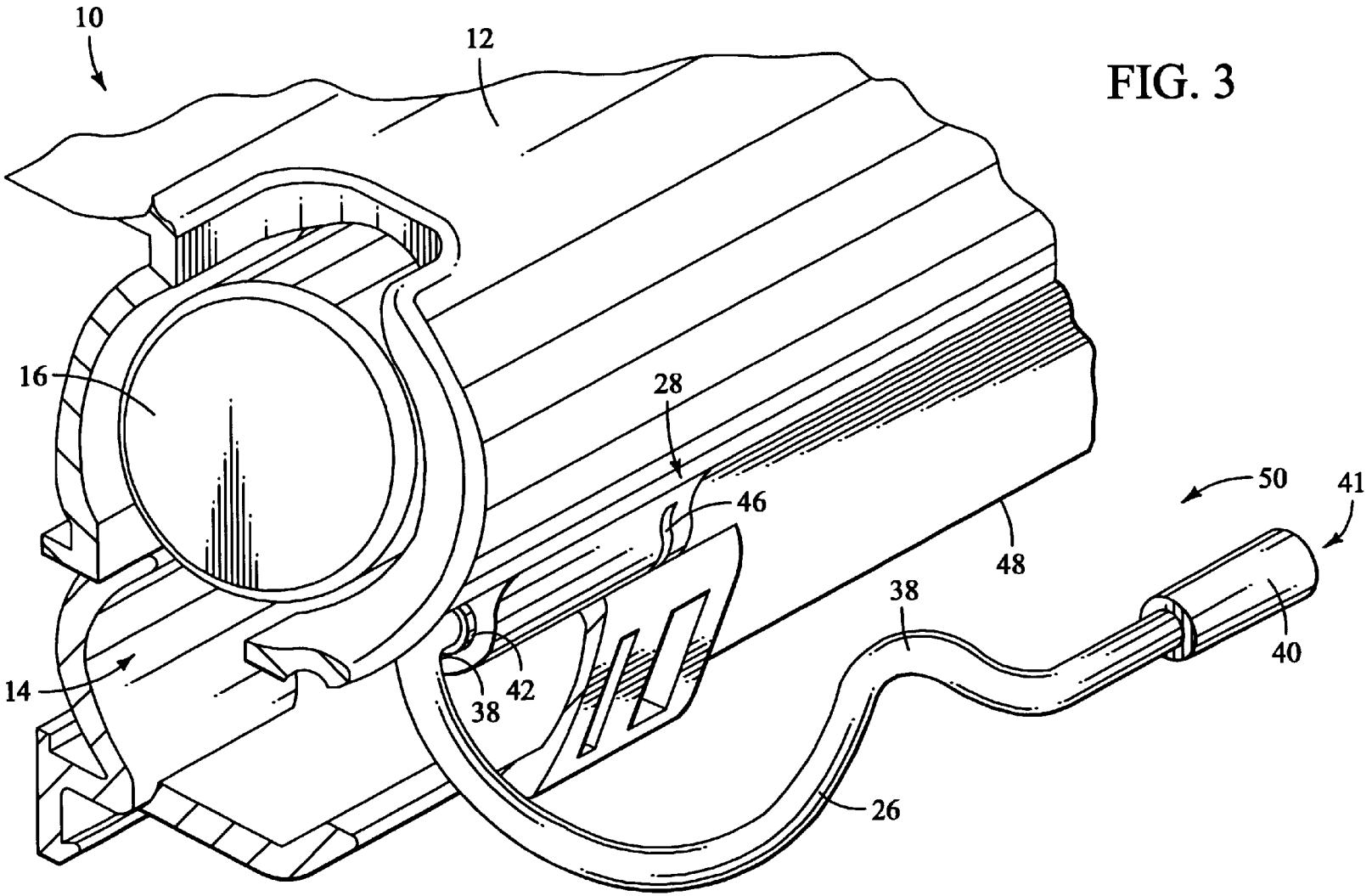
FIG. 3 is a fragmentary rear perspective view of the arm member of the combustion fastener tool in FIG. 1 in an open position.

Referring now to FIGS. 1 through 4, a preferred embodiment of a combustion fastener tool suitable for practicing the present invention is generally designated 10. The fastener tool 10 has a main housing 12 that defines a cavity 14 for receiving a self-contained internal power source or fuel cell 16, which is shown in FIGS. 2 and 3. The fuel cell 16 supplies fuel for combustion to an internal assembly (not shown) of the housing 12 that includes a combustion chamber in communication with a bore having a gas piston, bumper guards, and a driver blade disposed within. The tool 10 also has a nosepiece assembly 18 that attaches to the housing 12, and a magazine 20. The magazine 20 is configured for sequentially supplying fasteners (not shown) to the nosepiece assembly 18 which are impacted by the driver blade. A combustion-powered, fastener-driving tool available from ITW-Paslode (a unit of Illinois Tool Works, Inc.) of Lincolnshire, Ill., under its IMPULSE trademark is a preferred tool, into which these components can be readily incorporated. Such combustion-powered tools are similar to the tools disclosed in U.S. Pat. Nos. 4,403,722; 4,483,280; 4,483,474; 4,483,474; 4,522,162; 5,263,439; 6,016,622; and Re. 32,452, all of which are incorporated by reference.

Referring again to FIG. 1, through depression of a trigger 22 in a handle 24 of the tool 10, an operator induces combustion of a measured amount of the fuel or propellant from the power source 16, such as MAPP gas, within the combustion chamber. Upon ignition of the propellant in the combustion chamber, the piston is driven towards the nosepiece assembly 18. A bumper (not shown) is disposed within the bore and defines the end of travel of the piston as it travels toward the nosepiece assembly 18. As the piston approaches the nosepiece assembly 18, the driver blade will be guided into the nosepiece assembly 18 and impact a fastener which can be driven into a workpiece (not shown). Differential gas pressures return the piston back toward the combustion chamber after the piston completes its travel.

As a fuel cell protection feature, and for facilitating storage of the tool 10, an arm member or hook 26 is rotatably attached to the housing 12, preferably at a first end 28 of the arm member to partially enclose the fuel cell 16. The arm member 26 can rotate or pivot between a closed position (FIGS. 1 and 2) and an open position (FIG. 3) according to whether the tool 10 is being used or stored. The rotational feature of the arm member 26 is advantageous since it enables the arm member to have a dual purpose. First, in the closed position, the arm member 26 partially shields the fuel cell 16 from any impacts. Second, in the open position, the arm member 26 is configured for enabling the tool 10 to be easily stored or hung from a structure. Moreover, the arm member 26 is quickly rotatable to the closed position, permitting rapid use of the tool 10 once it is removed from its stored position. Preferably, the arm member 26 is formed of a metal material that can withstand deformation when the arm member is under stress, such as when the arm member supports the tool 10 in the open position or transfers an external impact to the housing 12 while in the closed position. However, other materials, including, but not limited to high-strength plastics, may be implemented to manufacture the arm member 26. A retaining clip 30, which is preferably integrally molded or otherwise attached or associated with a sidewall 32 of the housing 12, is configured for securing the arm member 26 to the housing 12. The use of the arm member 26 for storage of the tool 10 occurs upon the unclipping and rotation of the arm member, which is discussed more fully below with reference to FIG. 3.

Referring now to FIG. 2, the arm member 26 is shown attached to the clip 30 in a closed or protective position. The fuel cell 16 is positioned within the cavity 14, and is generally enclosed by the housing 12. In this position, the fuel cell 16 is protected from external side impacts, such as when the tool 10 is dropped on the tool side having the arm member 26 and designated generally by an arrow 34. In particular, the arm member 26 has a curved portion 36 that is preferably circular and is configured to at least partially encircle or surround the fuel cell 16 and transfer any impacts received by the curved portion to the housing 12 via elbows 38.

A handle 40 overlays a portion of a second end 41 of the arm member 26 to assist with rotation or the arm member. The handle 40 can be made of materials such as rubber, plastic, and the like. Preferably, the handle 40 is formed of a material which has a non-slip surface to reduce the likelihood of slippage of the tool 10 during placement or storage on a structure, such as a ladder, a rafter, a joist, etc. Furthermore, the non-slip surface facilitates user grasping of the handle 40 during unclipping of the arm member 26 from the clip 30.

The tool 10 also has a sleeve 42 with a bore, or a frictional member encircling a portion of the arm member 26 that is partially inserted into a chamber or cavity 44 formed by the housing 12. Preferably, the sleeve 42 is formed with the bore sized to ensure a snug fit with the inserted arm member. Furthermore, the sleeve should be thick enough to contact the housing 12 once inserted into the chamber 44. The sleeve 42 opposes or dampens a rotation of the arm member 26 to maintain the arm member in a particular rotational position, such as the closed position, unless overcome by user intervention. The chamber 44 is configured for receiving the first end 28 of the arm member 26, and preferably has a slit 46 extending into the chamber for receiving a clip, as is discussed more fully with reference to FIG. 4.

Referring now to FIG. 3, the tool 10 is shown with the arm member 26 unclipped from the retaining clip 30 and rotated to an open position. The handle 40 is generally parallel to a lower portion 48 of the housing 12 and forms a gap 50 that is configured to engage a rafter, joist or other projection from which the tool can be suspended or hung, either on or off site.

Figure 4:
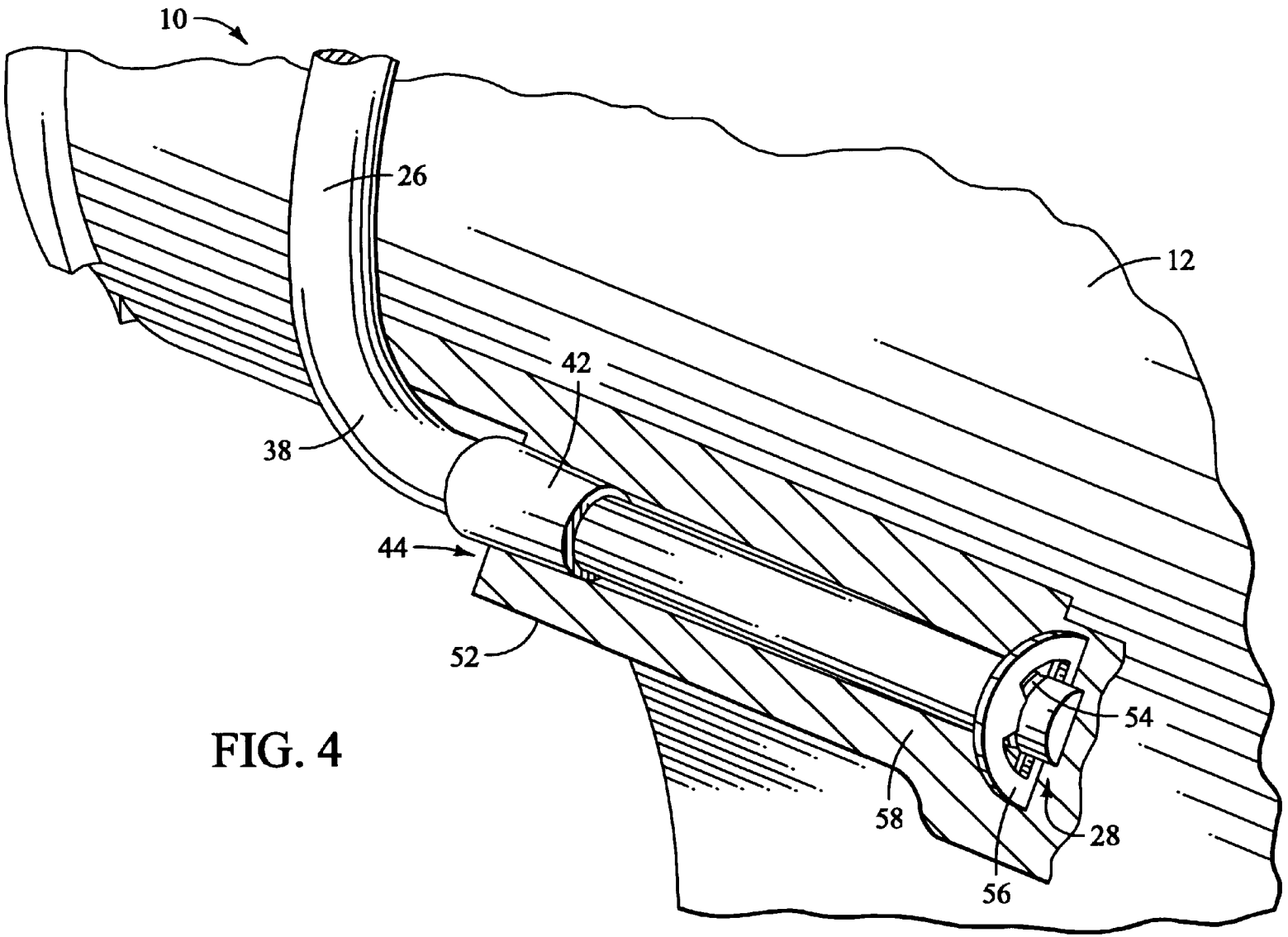
FIG. 4 is a fragmentary perspective view of the first end of the arm member of the combustion fastener tool of FIG. 1 with a portion of the housing removed.

FIG. 4 shows the first end 28 of the arm member 26 with a portion of the housing 12 removed. The sleeve 42 is partially enclosed by the housing 12 to oppose rotation of the arm member 26 as previously discussed. Preferably, the sleeve 42 has a snug fit to the housing 12 and is formed of a resilient material, such as rubber, plastic, etc., that can impart a frictional resistance between the arm member 26 an interior surface 52 of the chamber 44. Such resilient materials are preferable since they oppose rotation of the arm member 26 and retain the arm member in a fixed position unless rotated by a user.

The first end 28 of the arm member 26 has an annular groove 54 that is configured for receiving a clip 56. Preferably a metal material, the clip 56 can be formed of various materials, and is preferably configured as a C-clip. However, other types of clips known in the art for restricting axial movement may be incorporated herein, depending on the application. The C-clip 56 is preferably snap fit into the annular groove 54 by initially placing the second end 28 of the arm member 26 into the chamber 44 until the annular groove 54 is aligned with the slit 46. The C-clip 56 can then pass into the slit 46 to engage the annular groove 54 of the arm member 26. Interior chamber surfaces, such as a surface 58, prevent axial movement of the arm member 26 and C-clip 56 from the chamber 44. The retentive power of the clip 56 is strong enough to secure the arm member 26 to the housing 12 even when the arm member is in the open position (FIG. 3) and the tool 10 is suspended therefrom.

While a particular embodiment is shown in FIGS. 1–4 for the present arm member 26, numerous alternative embodiments are contemplated, wherein the arm member is attached to a different side of the tool 10, translated along the magazine 20 to a new location, etc. Moreover, it is contemplated that the arm member 26 can be configured for feeding into the chamber 44 in a reverse manner, wherein the arm member enters the chamber near the slit 46 and has an oppositely orientated curved portion configured to protect the fuel cell 16. Moreover, it is further contemplated that the present arm member 26 may include two separate components, wherein one component includes a curved section to protect the fuel cell 16 and the second component is capable of supporting the tool. The second component may or may not be rotatable in this alternative embodiment. Further, it is contemplated that the first and second ends of the arm member 26 may not be connected to one another in a single unit.

As described above with reference to the drawings, features of the present invention provide for protection of the fuel cell 16 when the arm member 26 has both ends attached to the housing 12 in the closed position. Additional features provide for storage of the tool 10 when the arm member is in an open position with one end attached to the housing. While a particular embodiment of the invention has been shown and described, it will be appreciated by those skilled in the art that changes and modifications may be made thereto without departing from the invention in its broader aspects and as set forth in the following claims.

What is claimed is:

1. A power tool configured for driving a driver blade in response to power from a power delivery source to impact a fastener and drive it into a workpiece, comprising:

a housing having a chamber at least partially enclosing the power delivery source;

an arm member directly connected to said housing and configured for storing the power tool when the arm member is in an open position, and for at least partially encircling a portion of the housing when the arm member is in a closed position to protect the power delivery source from an external impact; and a clip wherein said arm member has an annular groove at least partially ringing said arm member and configured for engaging said clip.

2. The power tool of claim 1, wherein said arm member has a first end connected to said housing and a second end being releasably connectable to said housing.

3. The tool as defined in claim 2, further comprising a retaining clip for engaging said first end of said arm member to connect said arm member to said housing.

4. The tool as defined in claim 3, wherein said arm member has an annular groove, and further including a slit in said housing configured for receiving said clip for engagement with said annular groove.

5. The tool as defined in claim 2, wherein the tool is a combustion powered tool further comprising a retaining clip associated with the housing for releasably engaging said second end of said arm member.

6. The tool as defined in claim 1, wherein said arm member further comprises a pair of elbows having a curved portion therebetween shaped to conform to a generally cylindrical portion of said housing.

7. The tool as defined in claim 1, further comprising a clamp means for fastening the arm member to the housing.

8. The tool as defined in claim 1, further comprising a frictional member configured for resisting rotational movement of said arm member.

9. A combustion powered tool having a self contained internal combustion power source constructed and arranged for creating a combustion for driving a driver blade to impact a fastener and drive it into a workpiece, comprising:

a housing having a fuel cell chamber configured for receiving a fuel cell;

a hook configured for protecting said fuel cell chamber from an external impact and storing the combustion powered tool; and a means for connecting said hook to said housing.

10. The tool as defined in claim 9, wherein said hook is configured for engagement with said housing between a closed position in which said hook protects the power delivery source and an open position in which said hook is used to store said tool.

11. The tool as defined in claim 9, further comprising:

a resistance member for opposing rotation of said hook; and a handle connected to said hook and configured for facilitating user engagement of said hook.

12. The tool as defined in claim 9, wherein said hook includes an annular groove and said means for connecting comprises a C-clip insertable in the housing and engaging said annular groove.

13. The tool as defined in claim 12, further comprising a retaining clip and wherein said hook has a first end engaging said C-clip and a second end engaging said retaining clip, said retaining clip configured for securing said second end to said housing.

14. A combustion power tool having a removable combustion power source constructed and arranged for creating a combustion for driving a driver blade to impact a magazine feed fastener and drive the fastener into a workpiece, comprising:

a hook capable of being slidingly secured to a structure and having a first end and a second end;

a housing having an interior surface configured for receiving said first end of said hook and an exterior surface configured for attaching to said second end of said hook; and wherein said hook includes a curved portion configured for at least partially surrounding a chamber of the removable combustion power source to protect said chamber upon attachment of said second end of said hook to said exterior surface.

15. The tool of claim 14, wherein said hook is rotatably mounted to said housing.

16. The tool of claim 15, further comprising a frictional member attached to said hook to resist rotational movement of said hook.

17. The tool of claim 14, further comprising a clip for engaging an annular groove of said second end of said hook and connecting said hook to said housing.

18. The tool of claim 17, wherein said housing defines a cavity and wherein said exterior surface of said housing has a slit configured for inserting said clip into said cavity for engagement with said annular groove.

19. The tool of claim 14 wherein said curved portion is circularly shaped.

20. A power tool configured for driving a driver blade in response to power from a power delivery source to impact a fastener and drive it into a workpiece, comprising:

a housing having a chamber at least partially enclosing the power delivery source; and an arm member directly connected to said housing and configured for storing the power tool when the arm member is in an open position, and for at least partially encircling a portion of the housing when the arm member is in a closed position to protect the power delivery source from an external impact, wherein said arm member has a first end connected to said housing and a second end being releasably connectable to said housing, and wherein the tool is a combustion powered tool further comprising a retaining clip associated with the housing for releasably engaging said second end of said arm member.

* * * * *